US010930194B2

(12) United States Patent
Lin

(10) Patent No.: US 10,930,194 B2
(45) Date of Patent: Feb. 23, 2021

(54) DISPLAY METHOD AND DISPLAY SYSTEM FOR REDUCING IMAGE DELAY BY ADJUSTING AN IMAGE DATA CLOCK SIGNAL

(71) Applicants: BenQ Intelligent Technology (Shanghai) Co., Ltd, Shanghai (CN); BENQ CORPORATION, Taipei (TW)

(72) Inventor: Hsin-Nan Lin, Taipei (TW)

(73) Assignees: BenQ Intelligent Technology (Shanghai) Co., Ltd, Shanghai (CN); BENQ CORPORATION, Taipei (TW)

( * ) Notice: Subject to any disclaimer, the term of this patent is extended or adjusted under 35 U.S.C. 154(b) by 0 days.

(21) Appl. No.: 16/819,198

(22) Filed: Mar. 16, 2020

(65) Prior Publication Data

US 2020/0302848 A1 Sep. 24, 2020

(30) Foreign Application Priority Data

Mar. 22, 2019 (CN) ..... 201910221462.9

(51) Int. Cl.
*G09G 3/20* (2006.01)

(52) U.S. Cl.
CPC ..... *G09G 3/20* (2013.01); *G09G 2320/0247* (2013.01); *G09G 2370/14* (2013.01)

(58) Field of Classification Search
CPC ..... G09G 3/34; G09G 3/3406; G09G 5/008; G09G 5/10; G09G 5/18; G09G 2310/0237; G09G 2310/08; G09G 2320/0247; G09G 2320/0257; G09G 2320/0261; G09G 2320/064; G09G 2340/0435
See application file for complete search history.

(56) References Cited

U.S. PATENT DOCUMENTS

2005/0195148 A1 9/2005 Iisaka
2006/0017713 A1* 1/2006 Lee ..... G09G 3/3611 345/204
2010/0097367 A1* 4/2010 Kitayama ..... G09G 3/3614 345/213
2016/0275916 A1 9/2016 Glen
(Continued)

FOREIGN PATENT DOCUMENTS

CN 109215586 A 1/2019
TW 200532610 10/2005
(Continued)

*Primary Examiner* — Nelson M Rosario
(74) *Attorney, Agent, or Firm* — Winston Hsu

(57) ABSTRACT

A display method for reducing image delay includes setting a transmission rate of a panel data clock signal of a display panel, setting a vertical synchronization period of a vertical synchronization signal according to at least the transmission rate of the panel data clock signal, and adjusting an image data clock signal outputted from a signal source according to the vertical synchronization period for synchronizing the panel data clock signal and the image data clock signal. The vertical synchronization period includes a first active interval and a first blanking interval. The image data clock signal has a period including a second active interval and a second blanking interval. A time offset between the first active interval and the second active interval is minimized. A time offset between the first blanking interval and the second blanking interval is minimized.

14 Claims, 6 Drawing Sheets

(56) References Cited

U.S. PATENT DOCUMENTS

| | | | | |
|---|---|---|---|---|
| 2017/0118443 | A1 | 4/2017 | Kim | |
| 2018/0090080 | A1 | 3/2018 | Chen | |
| 2018/0174551 | A1 | 6/2018 | Ansari | |
| 2018/0191996 | A1 | 7/2018 | Malemezian | |
| 2020/0219454 | A1* | 7/2020 | Fan | G09G 3/3426 |

FOREIGN PATENT DOCUMENTS

| | | | |
|---|---|---|---|
| TW | 201243821 | A1 | 11/2012 |
| TW | I527008 | B | 3/2016 |

* cited by examiner

DISPLAY METHOD AND DISPLAY SYSTEM FOR REDUCING IMAGE DELAY BY ADJUSTING AN IMAGE DATA CLOCK SIGNAL

BACKGROUND OF THE INVENTION

1. Field of the Invention

The present invention illustrates a display method and a display system for reducing image delay, and more particularly, a display method and a display system for reducing image delay by adjusting an image data clock signal to synchronize with a panel data clock signal.

2. Description of the Prior Art

Liquid crystal display (LCD) devices and organic light-emitting diode (OLED) devices have been widely used in our daily life because they take several advantages of thin appearance, low power consumption, and no radiation. For example, the LCD devices and OLED devices can be applied to multimedia players, mobile phones, personal digital assistants, computer monitors, or flat-screen TVs.

A conventional display device uses a pulse width modulation signal for driving a backlight source when images are displayed on a screen. The backlight source is enabled or disabled during a time interval greater than an image frame duration according to the pulse width modulation signal. Therefore, a user is easily disturbed by an unpleasant image flickering effect when the image is displayed, thereby reducing the visual quality. Specifically, images having high frequency or images including high-speed motion objects are prone to generate motion blur effects, leading to reduced image quality. Further, the user can see a transient effect of unstable pixels when the image is processed by refreshing their pixel polarities during the time interval of the enabled backlight source. Therefore, it is easy for the user to see the unpleasant image flickering effect or a double-image effect. Moreover, even if the user does not notice the image flickering effect of the screen when a high-speed image flickering effect or a high-frequency image flickering effect occurs, the user may unconsciously feel tired or suffer from permanent vision damage after watching flickering images for a long time. In order to reduce a pixel refreshing time length of the image received by human eyes, some advanced LCD devices use a pulse-type backlight technology for separating a time interval of enabling the backlight source from a time interval of refreshing pixels of the image. Theoretically, when the backlight source is enabled during a time interval of stabilized LCD pixels, the motion blur effect can be avoided.

When the time interval of enabling the backlight source is separated from the time interval of refreshing pixels of the image, a blanking interval of a vertical synchronization signal has to be increased for maintaining average brightness of the image and avoiding the motion blur effect. However, after the blanking interval of the vertical synchronization signal is increased, a time difference is present between a panel data clock signal of the display and an image data clock signal generated by a signal source. Further, when the panel data clock and the image data clock signal are asynchronous, an image input delay becomes severe, leading to the degradation of operational controllability and reducing the quality of visual interactive experience.

SUMMARY OF THE INVENTION

In an embodiment of the present invention, a display method for reducing image delay is disclosed. The display method comprises setting a transmission rate of a panel data clock signal of a display panel, setting a vertical synchronization period of a vertical synchronization signal according to at least the transmission rate of the panel data clock signal, and adjusting an image data clock signal outputted from a signal source according to the vertical synchronization period for synchronizing the panel data clock signal and the image data clock signal. The vertical synchronization period comprises a first active interval and a first blanking interval. The image data clock signal has a period comprising a second active interval and a second blanking interval. A time offset between the first active interval and the second active interval is minimized. A time offset between the first blanking interval and the second blanking interval is minimized.

In another embodiment of the present invention, a display system is disclosed. The display system comprises a display panel, a gate driving circuit, a data driving circuit, a timing controller, a backlight device, a processor, and a signal source. The display panel comprises a plurality of pixels for displaying an image. The gate driving circuit is coupled to the plurality of pixels. The data driving circuit is coupled to the plurality of pixels. The timing controller is coupled to the gate driving circuit and the data driving circuit for controlling the gate driving circuit and the data driving circuit. The backlight device is configured to provide a backlight signal. The processor is coupled to the timing controller and the backlight device for controlling the timing controller and the backlight device. The signal source is coupled to the processor and configured to generate an image data clock signal. After a transmission rate of a panel data clock signal of the display panel and a vertical synchronization period of a vertical synchronization signal are configured, the processor controls the signal source for adjusting the image data clock signal outputted from the signal source according to the vertical synchronization period. The vertical synchronization period comprises a first active interval and a first blanking interval. The image data clock signal has a period comprising a second active interval and a second blanking interval. A time offset between the first active interval and the second active interval is minimized. A time offset between the first blanking interval and the second blanking interval is minimized.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
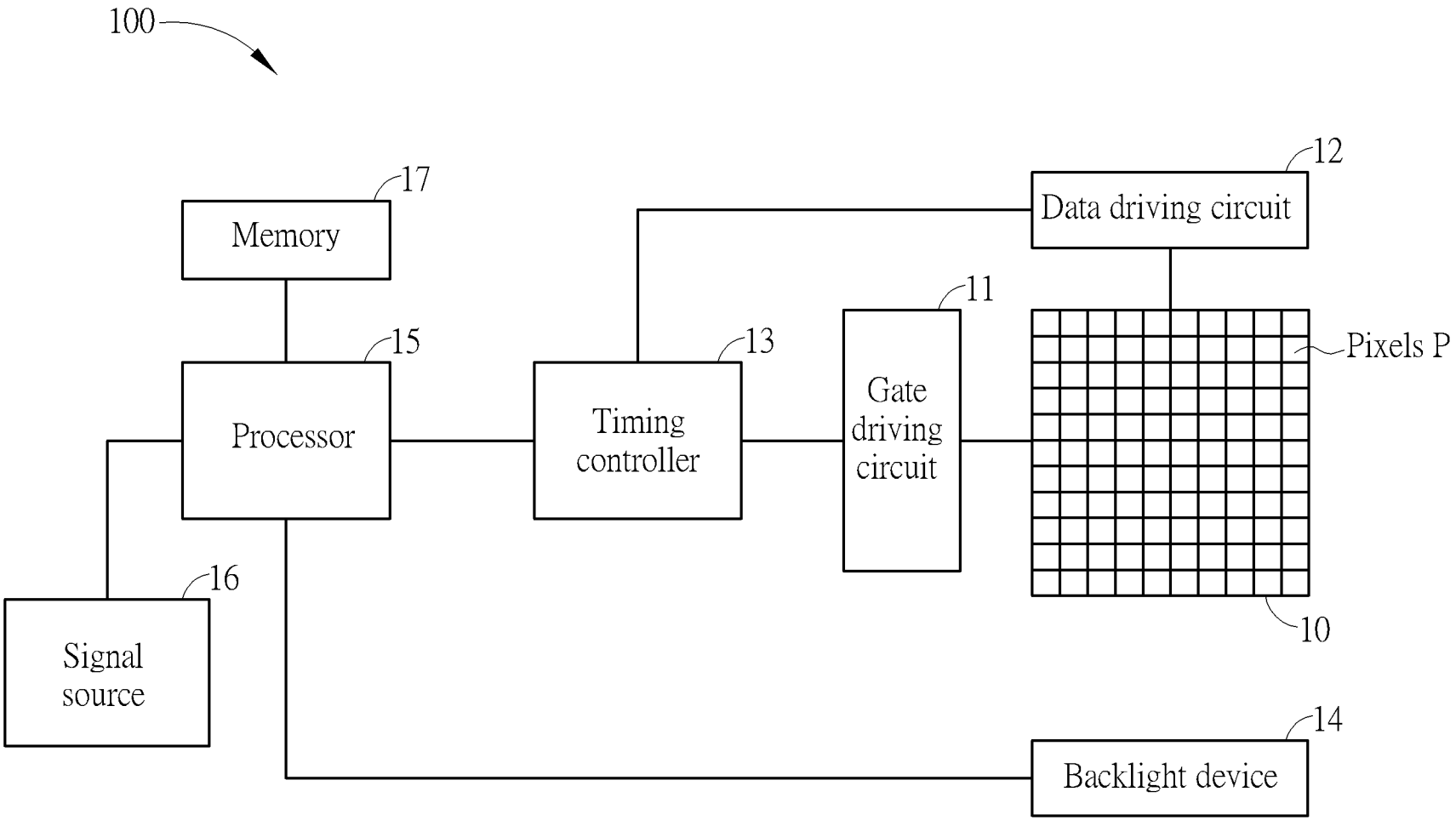
FIG. 1 is a block diagram of a display system according to an embodiment of the present invention.

FIG. 1 is a block diagram of a display system 100 according to an embodiment of the present invention. The display system 100 includes a display panel 10, a gate driving circuit 11, a data driving circuit 12, a timing controller 13, a backlight device 14, a processor 15, and a signal source 16. The display panel 10 can be any type of display panel, such as a display panel of a liquid crystal display (LCD) device or a display panel of an organic light-emitting diode (OLED) device. The display panel 10 includes a plurality of pixels P for displaying an image. The pixels P can be allocated in a form of a pixel array for displaying a rectangular image. The gate driving circuit 11 is coupled to the pixels P and can control a plurality of control terminals of the pixels P by using gate voltages under a row-by-row scanning process. Then, an enabling state and a disabling state of each pixel P can be controlled. The data driving circuit 12 is coupled to the pixels P and can transmit data voltages to the pixels P by using a column-by-column scanning process. Therefore, the pixels P can display different colors and different gray levels. The timing controller 13 is coupled to the gate driving circuit 11 and the data driving circuit 12 for controlling the gate driving circuit 11 and the data driving circuit 12. The timing controller 13 can be a logic board (T-CON). It can be regarded as a core circuit for controlling various timing operations of the display panel 10. The timing controller 13 can be used for controlling the gate driving circuit 11 and the data driving circuit 12 to scan the pixels P according to various timing clocks. The timing controller 13 can also convert an input video signal (i.e., such as a low-voltage differential signal, LVDS) into an appropriate data signal (i.e., such as a reduced swing differential signal, RSDS) used for driving internal circuits. The backlight device 14 is used for providing a backlight signal. The backlight device 14 can be any controllable light-emitting device. For example, the backlight device 14 can be a light-emitting diode array, an incandescent light bulb, an electroluminescent panel (ELP), or a cold cathode fluorescent lamp (CCFL). The processor 15 is coupled to the timing controller 13 and the backlight device 14 for controlling the timing controller 13 and the backlight device 14. The processor 15 can be a processing chip (i.e., a scaler) disposed inside the display system 100, or can be a microprocessor having a programmable capability. The processor 15 can save a plurality of data sets of timing control parameters. The processor 15 can use an inter-integrated circuit bus (I2C) for communicating with the timing controller 13. The signal source 16 is coupled to the processor 15. The processor 15 can receive an image data clock signal generated by the signal source 16. The image data clock signal generated by the signal source 16 can be a data clock signal generated by a graphics card of an external computer, or a data clock signal generated by an audio/video player (i.e., such as a DVD player). The display system 100 can further include a memory 17. The memory 17 is coupled to the processor 15 for saving extended display identification data (EDID) of the display panel 10. Any reasonable hardware modification falls into the scope of the present invention.

In the display system 100, after a transmission rate of a panel data clock signal of the display panel 10 and a vertical synchronization period of a vertical synchronization signal are configured, the processor 15 controls the signal source 16 for adjusting the image data clock signal outputted from the signal source 16 according to the vertical synchronization period. After the image data clock signal is adjusted, the image data clock signal and the panel data clock signal are synchronous. In other words, the vertical synchronization period includes a first active interval and a first blanking interval. The image data clock signal has a period including a second active interval and a second blanking interval. After the image data clock signal is adjusted, a time difference between the first active interval and the second active interval is minimized. A time difference between the first blanking interval and the second blanking interval is minimized. Further, since the panel data clock signal is synchronized with the image data clock signal, when the timing controller 13 controls the gate driving circuit 11 and the data driving circuit 12 for driving the pixels P during the first active interval to generate an image, the image delay can be avoided. Therefore, the quality of visual interactive experience can be increased. Details of the display method of the display system 100 for reducing the image delay are illustrated later.

Figure 2:
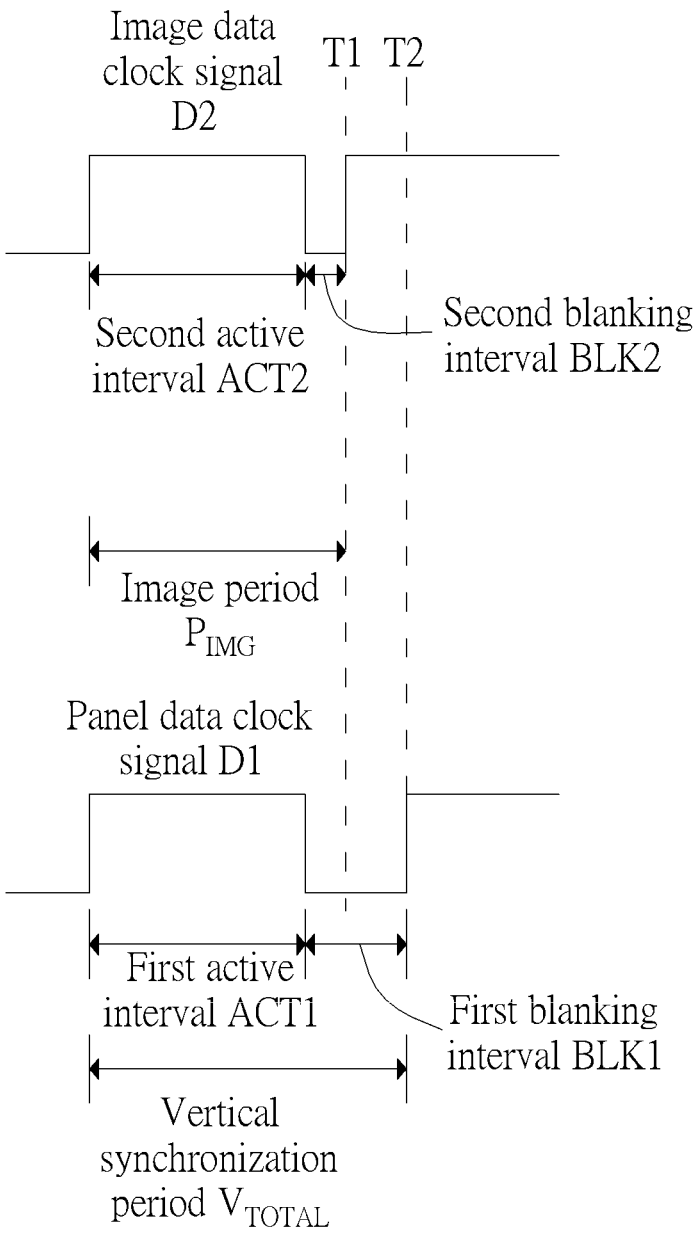
FIG. 2 is an illustration of generating an image delay by adjusting a panel data clock signal of the display system in FIG. 1.

FIG. 2 is an illustration of generating the image delay by adjusting the panel data clock signal D1 of the display system 100. As shown in FIG. 2, the panel data clock signal D1 of the display panel is a periodic signal. The period is equal to the vertical synchronization period $V_{TOTAL}$ of the vertical synchronization signal. The vertical synchronization period $V_{TOTAL}$ includes a first active interval ACT1 and a first blanking interval BLK1. The pixels P of the display panel 10 are transient during the first active interval ACT1. The pixels P of the display panel 10 are stable during the first blank interval BLK1. Therefore, in order to avoid visible motion blur of the display panel 10, the processor 15 can enable the backlight device 14 of the display panel 10 during a time period of any length within the first blanking interval BLK1. Further, the processor 15 can disable the backlight device 14 outside the first blanking interval BLK1. The first active interval ACT1 and an interval for enabling the backlight device 14 are non-overlapped. By doing so, the "transient" pixels P of the image are invisible. Therefore, the motion blur can be avoided. In practice, the transmission rate $P_{DATA}$ of the panel data clock signal D1, a horizontal synchronization period $H_{TOTAL}$ of a horizontal synchronization signal, and the vertical synchronization period $V_{TOTAL}$ of the vertical synchronization signal satisfy an equation:

$$P_{DATA}=H_{TOTAL}\times V_{TOTAL}\times \mathrm{FR}$$

FR is a frame rate constant. For example, when the transmission rate $P_{DATA}$ is equal to 174.9 M per second (Hz), the horizontal synchronization period $H_{TOTAL}$ can be 2200 (the number of pixels), and the vertical synchronization period $V_{TOTAL}$ can be 1325 (the number of pixels). The frame rate FR can be 60 (Hz). The aforementioned parameters satisfy the equation of 174.9 M=2200×1325×60. In order to increase a maximum time length for enabling the backlight device 14 for enhancing supportability of image brightness, a large vertical synchronization period $V_{TOTAL}$ is preferable for the display system 100. According to the equation $P_{DATA}=H_{TOTAL}\times V_{TOTAL}\times \mathrm{FR}$, for a constant frame rate FR and horizontal synchronization period $H_{TOTAL}$, when the transmission rate $P_{DATA}$ of the panel data clock signal D1 is increased, the vertical synchronization period $V_{TOTAL}$ of the vertical synchronization signal is increased. Since a time length of the first active interval ACT1 is also a constant, when the vertical synchronization period $V_{TOTAL}$ is increased, a time length of the first blanking interval BLK1 is increased. Since the first blanking interval BLK1 can be regarded as a period for enabling the backlight device 14, when the time length of the first blanking interval BLK1 is increased, it implies that the display system 100 can display a brighter image.

However, although the motion blur can be avoided by merely enabling the backlight device 14 during the first blanking interval BLK1, the display system 100 requires a frame buffer since the panel data clock signal D1 and the image data clock signal D2 are asynchronous. Further, severe image input delay is also introduced, as illustrated below. As shown in FIG. 2, the image data clock signal D2 generated by the signal source 16 has an image period $P_{IMG}$. The image period $P_{IMG}$ includes a second active interval ACT2 and a second blanking interval BLK2. The end of the image period $P_{IMG}$ corresponds to a time point T1. However, as previously mentioned, in order to enhance maximum image brightness supported by the display system 100, the first blanking interval BLK1 of the panel data clock signal D1 can be adjusted. Therefore, the vertical synchronization period $V_{TOTAL}$ is adjusted accordingly. Here, the end of the vertical synchronization period $V_{TOTAL}$ corresponds to a time point T2. A time length of the first active interval ACT1 is equal to a time length of the second active interval ACT2, such as a period of scanning 1024 pixels. However, since the second blanking interval BLK2 is different from the first blanking interval BLK1, a large time difference is present between the panel data clock signal D1 and the image data clock signal D2, such as a time difference from the time point T1 to the time point T2. For example, the time difference from the time point T1 to the time point T2 can be modeled as X+Y. X can be regarded as an additional time length for adjusting the second blanking interval BLK2 to approach the first blanking interval BLK1. For example, X=200 denotes the additional time length of scanning additional 200 pixels in a vertical direction. Y can be regarded as an inherent time delay length. For example, Y=3 denotes the inherent time delay length of scanning 3 pixels in the vertical direction. In FIG. 2, the time difference between the panel data clock signal D1 and the image data clock signal D2 is equal to |T1−T2|, such as |T1−T2|=203. Therefore, since the panel data clock signal D1 and the image data clock signal D2 are asynchronous, it results in significant image input delay, thereby reducing the quality of visual interactive experience. Therefore, the display system 100 can adjust the image data clock signal D2 for reducing the image input delay. Details are illustrated later.

Figure 3:
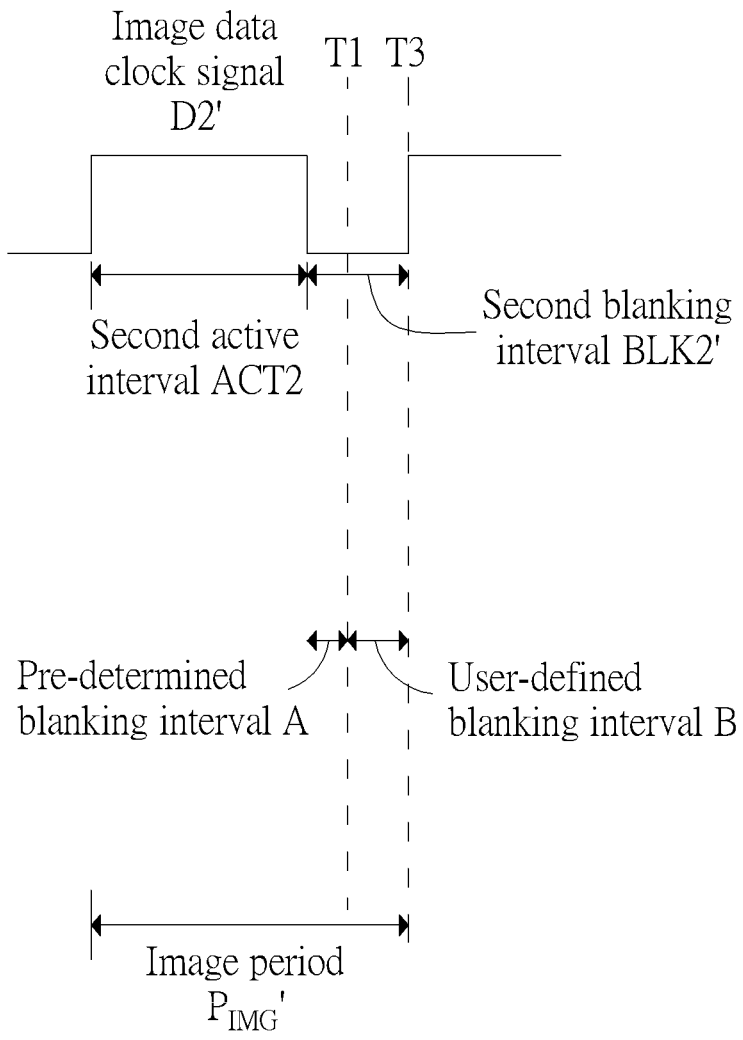
FIG. 3 is an illustration of adjusting an image data clock signal of the display system in FIG. 1.

FIG. 3 is an illustration of adjusting the image data clock signal D2 of the display system 100. In FIG. 3, for avoiding ambiguity, after the image data clock signal D2 is adjusted, the image data clock signal D2 is called as an image data clock signal D2' hereafter. As previously mentioned in FIG. 2, the severe time difference is present between the panel data clock signal D1 and the image data clock signal D2. A reason is that the length of the first blanking interval BLK1 and the length of the second blanking interval BLK2 are different. Therefore, in the display system 100, as shown in FIG. 3, the second blanking interval BLK2 is adjusted to the second blanking interval BLK2'. The second blanking interval BLK2' of the image data clock signal D2' includes a pre-determined blanking interval A and a user-defined blanking interval B. Particularly, the pre-determined blanking interval A can be configured by the signal source 16. For example, a time length of the pre-determined blanking interval A can be equal to a time length of the second blanking interval BLK2 in FIG. 2. Therefore, the pre-determined blanking interval A can be regarded as an "initial" blanking interval. A time length of the user-defined blanking interval B can be equal to X. As previous definition, X can be regarded as the additional time length for adjusting the second blanking interval BLK2 to approach the first blanking interval BLK1 in FIG. 2. For example, X=200 denotes the additional time length of scanning additional 200 pixels in the vertical direction. In other words, in the image data clock signal D2 in FIG. 2, the time length of the second blanking interval BLK2 is equal to the time length of the pre-determined blanking interval A. However, the time length of the second blanking interval BLK2' of the image data clock signal D2' includes the time length of the pre-determined blanking interval A and a time length X of the user-defined blanking interval B. Since the second blanking interval BLK2 is adjusted to the second blank interval BLK2', the image period $P_{IMG}$ is also adjusted to an image period $P_{IMG}'$. Further, an end time point of the image period is also adjusted from the time point T1 to the time point T3. Therefore, since the time length of the second blanking interval BLK2' in FIG. 3 is longer than the time length of the second blanking interval BLK2 in FIG. 2 (i.e., unadjusted), the image input delay can be mitigated, as illustrated below.

Figure 4:
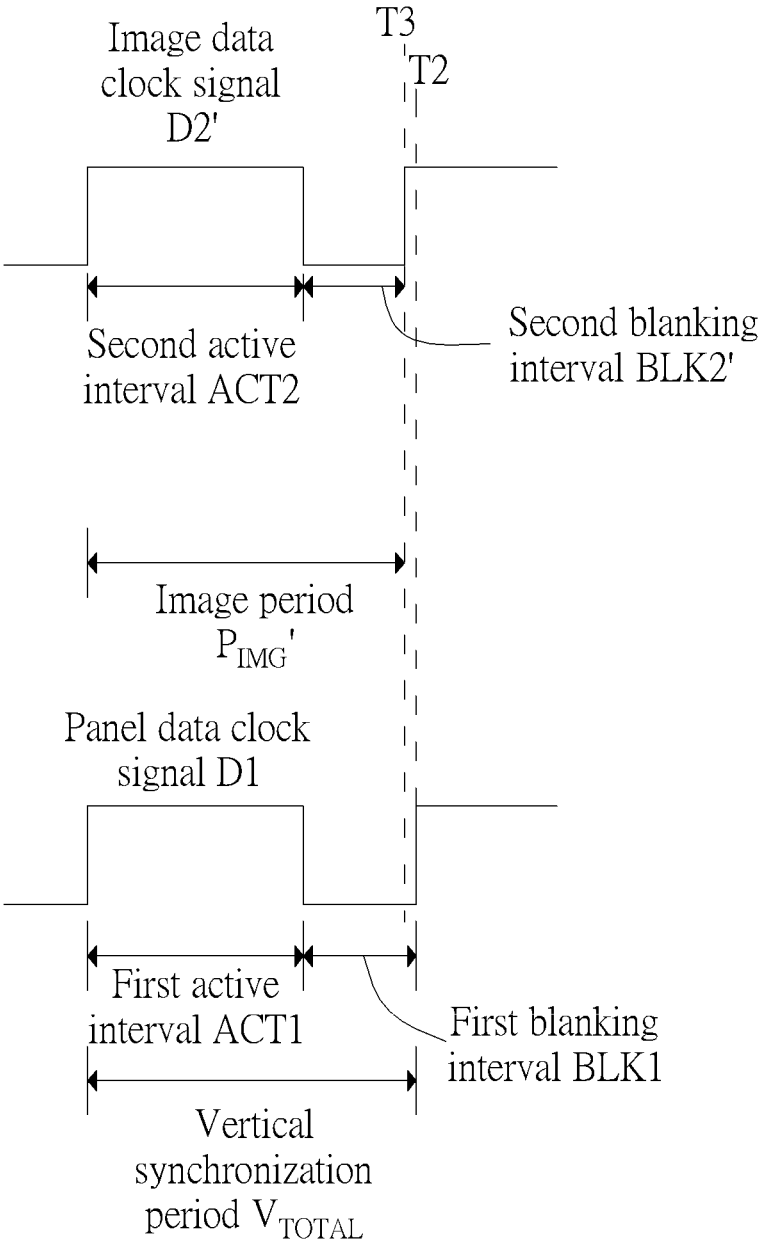
FIG. 4 is an illustration of reducing the image delay by adjusting the image data clock signal of the display system in FIG. 1.

FIG. 4 is an illustration of reducing the image delay by adjusting the image data clock signal D2' of the display system 100. As shown in FIG. 4, after the image data clock signal D2 is adjusted to the image data clock signal D2', the image period $P_{IMG}'$ of the image data clock signal D2' includes the second active interval ACT2 and the second blanking interval BLK2'. The time length of the second blanking interval BLK2' of the image data clock signal D2' includes the time length of the pre-determined blanking interval A and a time length X of a user-defined blanking interval B. As previously mentioned, for the panel data clock signal D1, the vertical synchronization period $V_{TOTAL}$ includes the first active interval ACT1 and the first blank interval BLK1. The time length of the first blank interval BLK1 includes the time length of the pre-determined blanking interval A and the time length X of the user-defined blanking interval B. For example, X is equal to 200 (i.e., the time length for scanning 200 pixels). Comparing FIG. 2 with FIG. 4 shows a reason for the reduction of the image delay time, as illustrated below. The time difference between the "original" panel data clock signal D1 and the image data clock signal D2 is equal to |T1−T2|, such as |T1−T2|=203. However, after the image data clock signal D2 is adjusted to the image data clock signal D2', the time difference between the panel data clock signal D1 and the image data clock signal D2' is equal to |T3−T2|, such as |T3−T2|=3. A reduction of the time difference between the panel data clock signal D1 and the image data clock signal D2' implies that the image delay is mitigated. In other words, in FIG. 2, since the time difference is severe (i.e., |T1−T2|=203), the panel data clock signal D1 and the image data clock signal D2 are asynchronous. However, in FIG. 4, since the second blanking interval BLK2 is extended to approach the second blank interval BLK2', the time length of the first blank interval BLK1 and the time length of the second blank interval BLK2' are almost the same. Therefore, the panel data clock signal D1 and the image data clock signal D2' are almost synchronous, leading to the reduction of the image delay. In other words, in FIG. 4, only a short delay is present between the first blanking interval BLK1 of the panel data clock signal D1 and the second blank interval BLK2' of the "adjusted" image data clock signal D2', such as the delay of scanning |T3−T2|=3 pixels. Therefore, for a user, the short delay of displaying the image is imperceptible. Thus, the quality of visual interactive experience can be maintained.

Figure 5:
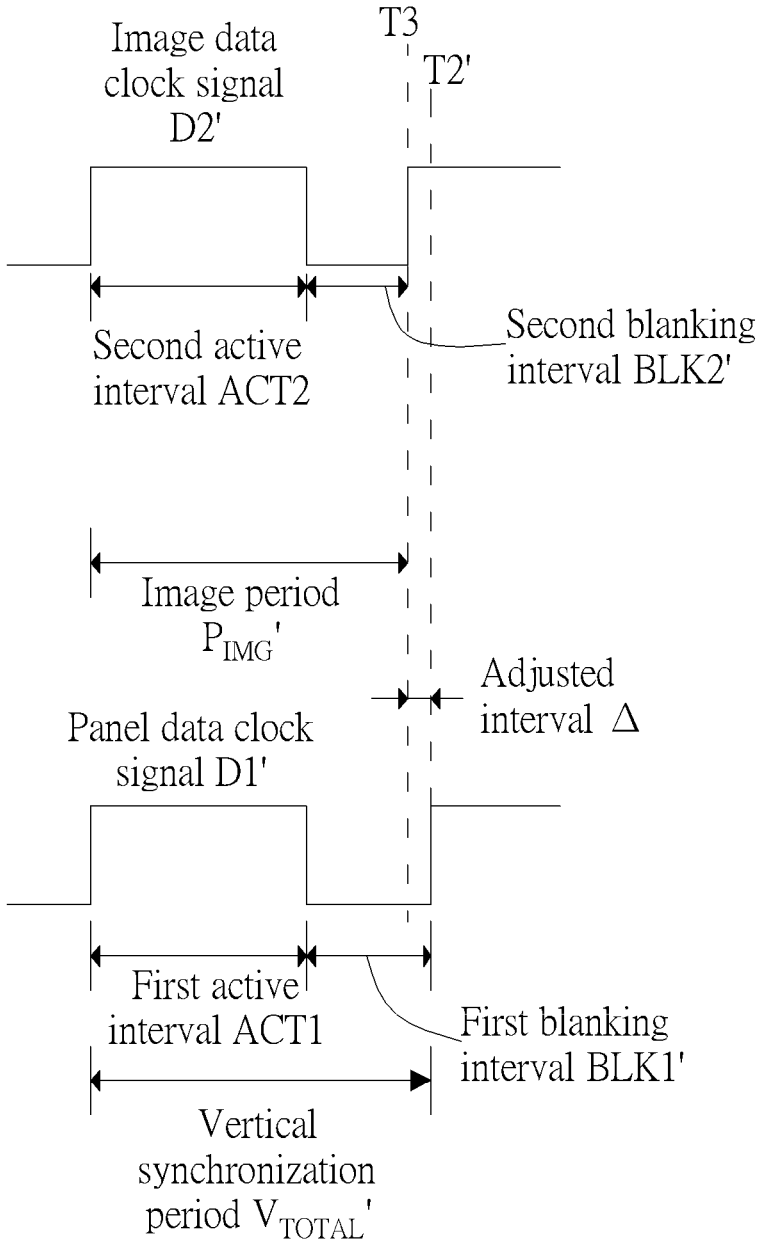
FIG. 5 is an illustration of introducing an adjusted interval to the panel data clock signal for increasing a time length of a first blanking interval of the display system in FIG. 1.

FIG. 5 is an illustration of introducing an adjusted interval A to the panel data clock signal D1 for increasing the time length of the first blanking interval BLK1' of the display system 100. For avoiding ambiguity, after the adjusted interval A is introduced to the panel data clock signal D1, the panel data clock signal D1 is called as a panel data clock signal D1' hereafter. In FIG. 5, for enhancing design flexibility, the panel data clock signal D1' of the display system 100 can further introduce the adjusted interval A for providing a high design balance between the image brightness supportability and the image delay time. In FIG. 5, the first blanking interval BLK1' further includes the adjusted interval Δ. A time length of the adjusted interval Δ is smaller than the time length X of the user-defined blanking interval B. For example, after the panel data clock signal D1 uses the user-defined blanking interval B having the time length X for increasing the time length of the first blank interval BLK1, the panel data clock signal D1 can further introduce the adjusted interval Δ for further increasing the time length of the first blank interval BLK1 to generate the first blank interval BLK1' in order to maximize the supportability of the image brightness. The time length X of the user-defined blanking interval B can be equal to 200 (i.e., X=200). The time length of the adjusted interval Δ can be equal to 50. After the first blanking interval BLK1 is adjusted to the first blanking interval BLK1', the vertical synchronization period is also adjusted from $V_{TOTAL}$ to $V_{TOTAL}'$. Therefore, the end time point of the vertical synchronization period $V_{TOTAL}'$ is also changed from T2 to T2'. Therefore, the time difference between the second blanking interval BLK2' and the second blanking interval BLK1' is increased to |T3−T2'|, such as |T3−T2'|=3+Δ=53. In other words, a total time difference between the image data clock signal D2' and the panel data clock signal D1' can be defined as a sum of the time length of the adjusted interval Δ and the inherent time delay length (i.e., 50+3=53). However, as previously mentioned, the display system 100 can introduce the adjusted interval Δ for providing the high design balance between the image brightness supportability and the image delay time. For example, when the display system 100 is operated in the word processing mode, an extremely short image delay time is not required for the user. Therefore, the time length of the adjusted interval Δ can be increased for enhancing the supportability of high image brightness. When the display system 100 is operated in a video game mode, the extremely short image delay time is required for the user. Therefore, the length of the adjusted interval Δ can be reduced to mitigate the image delay of the display system 100. In other words, after the display system 100 introduces the adjusted interval Δ, the visual experience can be optimized according to an appropriate mode selected by the user.

In the display system 100, any hardware modification falls into the scope of the present invention. For example, the display system 100 can further include a memory 17. The memory 17 is coupled to the processor 15 for saving extended display identification data (EDID) of the display panel 10. Further, data of the transmission rates of the panel data clock signals D1 and D2, and data of the vertical synchronization periods $V_{TOTAL}$ and $V_{TOTAL}'$ of the vertical synchronization signals belong to two user-defined timing data categories of the EDID. Further, the display panel 10 can use an on-screen-display (OSD) function for displaying a mode adjustment interface. The processor 15 can set the transmission rate of the panel data clock signal and the vertical synchronization period of the vertical synchronization signal through the mode adjustment interface. Further, the EDID in the memory 17 can be set to an enabling state so as to read the EDID by the signal source 16. In practice, the user can operate the display panel 10 by using the OSD function. Then, the display panel 10 can transmit a trigger signal to the signal source 16. The trigger signal can be a notification signal from a low voltage to a high voltage, such as a hot-plug signal. After the signal source 16 receives the trigger signal, the signal source 16 can read the EDID for generating the image data clock signal synchronized with the panel data clock signal. However, the display system 100 is not limited to the aforementioned operational modes. For example, the memory 17 can also be integrated with the signal source 16 on a motherboard. The signal source 16 can automatically read timing data saved in the memory 17 for generating the image data clock signal synchronized with the panel data clock signal. Further, the timing data saved in the memory 17 can also be configured or adjusted by the user in a preset mode. By doing so, after the user selects the preset mode through the OSD interface of the display panel 10, the signal source 16 can read the EDID information of the memory 17 according to the trigger signal. Then, the signal source can generate an image data clock signal having user-defined timing parameters.

Further, a definition of "synchronization" can be regarded as high time consistency between the panel data clock signal and the image data clock signal. In other words, even if an imperceptible time difference is introduced between the panel data clock signal and the image data clock signal, the two signals are still synchronous. For example, as previously mentioned in FIG. 2, the time difference between the panel data clock signal D1 and the image data clock signal D2 is equal to |T1−T2|, such as |T1−T2|=203. Since a time length of scanning 203 pixels is prone to be noticed by the user, the panel data clock signal D1 and the image data clock signal D2 are asynchronous. However, as previously mentioned in FIG. 4, the time difference between the panel data clock signal D1 and the "adjusted" image data clock signal D2' is equal to |T3−T2|=3. Since a time length of scanning 3 pixels cannot be easily noticed by the user, the panel data clock signal D1 and the "adjusted" image data clock signal D2' are substantially synchronous. In general, after reducing an noticeable time difference by more than 90%, a time difference corresponding to a time length of scanning a couple of units digits of pixels is imperceptible by the user.

Figure 6:
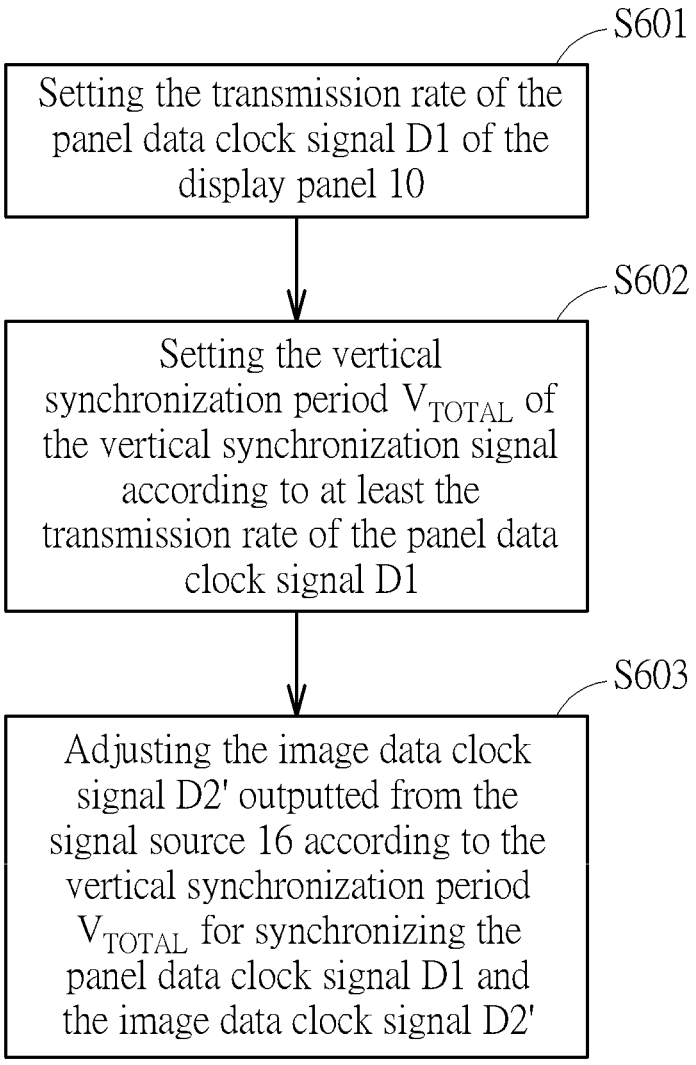
FIG. 6 is a flow chart of a display method for reducing image delay performed by the display system in FIG. 1.

FIG. 6 is a flow chart of a display method for reducing the image delay performed by the display system 100. The display method for reducing the image delay includes step S601 to step S603. Any reasonable technology modification falls into the scope of the present invention. Step S601 to Step S603 are illustrated below.

step S601: setting the transmission rate of the panel data clock signal D1 of the display panel 10;

step S602: setting the vertical synchronization period $V_{TOTAL}$ of the vertical synchronization signal according to at least the transmission rate of the panel data clock signal D1;

step S603: adjusting the image data clock signal D2' outputted from the signal source 16 according to the vertical synchronization period $V_{TOTAL}$ for synchronizing the panel data clock signal D1 and the image data clock signal D2'.

Details of step S601 to step S603 are previously illustrated. Thus, they are omitted here. In the present invention, correlations between the panel data clock signal D1 and the image data clock signal D2 may lead to the following results. (A) When the panel data clock signal D1 and the image data clock signal D2 are asynchronous (i.e., the time difference is equal to |T1−T2|=203), severe image delay is unavoidable. (B) After the image data clock signal D2 is adjusted to the image data clock signal D2', the panel data clock signal D1 and the image data clock signal D2' are substantially synchronous, such that the time difference is minimized to |T3−T2|=3. Therefore, the image delay can be greatly reduced. (C) Based on (B), when the panel data clock signal D1 introduces the adjusted interval Δ to generate the panel data clock signal D1', the time difference between the panel data clock signal D1' and the image data clock signal D2' is slightly increased. However, the adjusted interval Δ can be used for providing the high design balance between the image brightness supportability and the image delay time. In other words, the (B) mode and the (C) mode can be regarded as two solutions for mitigating severe image delay in the (A) mode. By doing so, the quality of visual interactive experience can be increased.

To sum up, the present invention discloses a display method and a display system for reducing image delay. After the display system adjusts an image data clock signal outputted from a signal source, the image data clock signal can be substantially synchronized with a panel data clock signal. Therefore, the image delay can be reduced. Further, after the display system introduces an adjusted interval for adjusting the clock signal of the panel data, image brightness supportability and the image delay time can be customized by a user. Therefore, when the display system uses the aforementioned display method in conjunction with a pulse-type backlight technology, the display system can provide low motion blur and low display latency images. Further, the display system can provide high supportability of image brightness, thereby increasing the quality of visual interactive experience.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display method for reducing image delay comprising:

setting a transmission rate of a panel data clock signal of a display panel;

setting a vertical synchronization period of a vertical synchronization signal according to at least the transmission rate of the panel data clock signal, using an on-screen-display function of the display panel for displaying a mode adjustment interface;

operating the mode adjustment interface for setting the transmission rate of the panel data clock signal and the vertical synchronization period of the vertical synchronization signal;

transmitting a trigger signal from the display panel to a signal source;

setting extended display identification data (EDID) to an enabling state so as to read the EDID by the signal source;

reading the EDID for generating an image data clock signal outputted from the signal source; and adjusting the image data clock signal outputted from the signal source according to the vertical synchronization period for synchronizing the panel data clock signal and the image data clock signal;

wherein data of the transmission rate of the panel data clock signal and data of the vertical synchronization period of the vertical synchronization signal belong to two user-defined timing data categories of the EDID, the vertical synchronization period comprises a first active interval and a first blanking interval, the image data clock signal has a period comprising a second active interval and a second blanking interval, a time offset between the first active interval and the second active interval is minimized, and a time offset between the first blanking interval and the second blanking interval is minimized.

2. The method of claim 1, wherein a time length of the first active interval is equal to a time length of the second active interval, and when the transmission rate of the panel data clock signal is increased, the vertical synchronization period of the vertical synchronization signal is increased and a length of the first blanking interval is increased.

3. The method of claim 1, further comprising:

enabling a backlight device of the display panel during a time period of any length within the first blanking interval; and disabling the backlight device outside the first blanking interval;

wherein the first active interval and an interval for enabling the backlight device are non-overlapped.

4. The method of claim 1, wherein the transmission rate of the panel data clock signal, a horizontal synchronization period of a horizontal synchronization signal, and the vertical synchronization period of the vertical synchronization signal satisfy an equation:

$$PDATA=HTOTAL\times VTOTAL\times FR$$

PDATA is the transmission rate, HTOTAL is the horizontal synchronization period, VTOTAL is the vertical synchronization period, and FR is a frame rate constant.

5. The method of claim 1, wherein the second blanking interval of the image data clock signal comprises a predetermined blanking interval and a user-defined blanking interval, the first blanking interval of the vertical synchronization period generated according to the panel data clock signal comprises the pre-determined blanking interval and the user-defined blanking interval, and a time difference is present between the first blanking interval and the second blanking interval.

6. The method of claim 5, wherein the first blanking interval further comprises an adjusted interval, and a time length of the adjusted interval is smaller than a time length of the user-defined blanking interval.

7. The method of claim 6, wherein a total time difference between the image data clock signal and the panel data clock signal is equal to a sum of the time length of the adjusted interval and the time difference between the first blanking interval and the second blanking interval.

8. A display system comprising:

a display panel comprising a plurality of pixels for displaying an image;

a gate driving circuit coupled to the plurality of pixels;

a data driving circuit coupled to the plurality of pixels;

a timing controller coupled to the gate driving circuit and the data driving circuit for controlling the gate driving circuit and the data driving circuit;

a backlight device configured to provide a backlight signal;

a processor coupled to the timing controller and the backlight device for controlling the timing controller and the backlight device;

a memory coupled to the processor and configured to save extended display identification data (EDID); and a signal source coupled to the processor and configured to generate an image data clock signal;

wherein after a transmission rate of a panel data clock signal of the display panel and a vertical synchronization period of a vertical synchronization signal are configured, the display panel uses an on-screen-display function for displaying a mode adjustment interface, the processor sets the transmission rate of the panel data clock signal and the vertical synchronization period of the vertical synchronization signal through the mode adjustment interface, the display panel transmits a trigger signal to the signal source, the EDID is set to an enabling state so as to read the EDID by the signal source, the signal source reads the EDID for generating the image data clock signal, and the processor controls the signal source for adjusting the image data clock signal outputted from the signal source to synchronize with the panel data clock signal according to the vertical synchronization period;

wherein data of the transmission rate of the panel data clock signal and data of the vertical synchronization period of the vertical synchronization signal belong to two user-defined timing data categories of the EDID; and wherein the vertical synchronization period comprises a first active interval and a first blanking interval, the image data clock signal has a period comprising a second active interval and a second blanking interval, a time offset between the first active interval and the second active interval is minimized, and a time offset between the first blanking interval and the second blanking interval is minimized.

9. The system of claim 8, wherein a time length of the first active interval is equal to a time length of the second active interval, and when the transmission rate of the panel data clock signal is increased, the vertical synchronization period of the vertical synchronization signal is increased and a length of the first blanking interval is increased.

10. The system of claim 8, wherein the processor enables the backlight device of the display panel during a time period of any length within the first blanking interval, and the processor disables the backlight device outside the first blanking interval, and the first active interval and an interval for enabling the backlight device are non-overlapped.

11. The system of claim 8, wherein the transmission rate of the panel data clock signal, a horizontal synchronization period of a horizontal synchronization signal, and the vertical synchronization period of the vertical synchronization signal satisfy an equation:

$$P_{DATA}=H_{TOTAL}\times V_{TOTAL}\times \mathrm{FR}$$

$P_{DATA}$ is the transmission rate, $H_{TOTAL}$ is the horizontal synchronization period, $V_{TOTAL}$ is the vertical synchronization period, and FR is a frame rate constant.

12. The system of claim 8, wherein the second blanking interval of the image data clock signal comprises a pre-determined blanking interval and a user-defined blanking interval, the first blanking interval of the vertical synchronization period generated according to the panel data clock signal comprises the pre-determined blanking interval and the user-defined blanking interval, and a time difference is present between the first blanking interval and the second blanking interval.

13. The system of claim 12, wherein the first blanking interval further comprises an adjusted interval, and a time length of the adjusted interval is smaller than a time length of the user-defined blanking interval.

14. The system of claim 13, wherein a total time difference between the image data clock signal and the panel data clock signal is equal to a sum of the time length of the adjusted interval and the time difference between the first blanking interval and the second blanking interval.

* * * * *